US005685658A

United States Patent [19]

Woodruff

[11] Patent Number: 5,685,658

[45] Date of Patent: Nov. 11, 1997

[54] DYNAMICALLY PIVOTING MULTIPLE ROLLER-BRUSH SPRAY APPLICATOR

[75] Inventor: Byron J. Woodruff, Santa Clara, Calif.

[73] Assignee: Paint Trix Inc., Sunnyvale, Calif.

[21] Appl. No.: 568,196

[22] Filed: Dec. 6, 1995

[51] Int. Cl.[6] ..... B05C 17/02; B05C 17/03

[52] U.S. Cl. ..... 401/208; 401/218; 401/219

[58] Field of Search ..... 401/219, 218, 401/208

[56] References Cited

U.S. PATENT DOCUMENTS

| | | | |
|---|---|---|---|
| 2,610,582 | 9/1952 | Sprung | 401/218 X |
| 3,015,837 | 1/1962 | Teall | 401/205 |
| 3,195,170 | 7/1965 | Howard | 401/219 X |
| 4,059,358 | 11/1977 | Arai | 401/219 |
| 4,140,410 | 2/1979 | Garcia | 401/150 |
| 5,271,683 | 12/1993 | Snetting et al. | 401/195 |

FOREIGN PATENT DOCUMENTS

| | | | |
|---|---|---|---|
| 2914030 | 10/1979 | Germany | 401/219 |
| 1009522 | 4/1983 | Russian Federation | 401/208 |

OTHER PUBLICATIONS

Titan Tool, Inc., "Airless Acessories" brochure.

Paint Smart, Inc., "Quick Reach ™ Spray Pole" brochure and price list (Jan. 15, 1995).

*Primary Examiner*—Steven A. Bratlie
*Attorney, Agent, or Firm*—Thomas Schneck

[57] ABSTRACT

A fluid applicator for surfaces combining a spray-gun with dynamically displacable roller-brushes. The angle of a fluid stream exiting the nozzle is allowed to vary with respect to the longitudinal axis of the roller-brushes to more accurately control over-spray, especially with surfaces in close proximity with one another. The roller-brush applicator includes a frame having first and second opposed ends, with a clamp, attached to the first end, for attaching the frame proximate to the nozzle, and a cross-member pivotally mounted to the second end to rotate about a pivot axis. The cross-member preferably includes a pair of spaced-apart roller-brushes, each of which is rotatably mounted to a shaft. The shafts extend parallel to, and are disposed on opposite sides of, the pivot axis. The nozzle defines a flow path extending between the spaced-apart roller-brushes, transverse to the pivot axis.

20 Claims, 4 Drawing Sheets

DYNAMICALLY PIVOTING MULTIPLE ROLLER-BRUSH SPRAY APPLICATOR

TECHNICAL FIELD

The present invention relates to an apparatus for simultaneously spraying and rolling fluid onto surfaces.

BACKGROUND ART

Various applicators may be employed to deposit fluid, such as paint, onto a surface, e.g. bristle-brushes, roller-brushes and high and low pressure spray-guns. The choice of applicator is typically dependent upon the texture of the surface to which the paint will be deposited. For example, traditional bristle-brush applicators, of the type having a plurality of bristles extending parallel to an axis of a handle, have been found particularly useful for depositing paint onto surfaces having a rough texture, which include recesses. A problem with the traditional bristle-brush is that the paint, to be deposited on a surface, is kept in a reservoir which is remotely disposed with respect to the surface. This results in a great amount of time being consumed moving the bristle-brush between the reservoir and the surface. Movement between the surface and the reservoir also increases the probability that paint may drip from the bristles which increases the quantity of paint required to complete a particular project, thereby reducing the transfer efficiency of the bristle-brush. Also, the paint is often placed on the surface in a non-uniform manner, being thicker in areas where the bristle-brush is first applied thereto. Thus, many strokes are required to spread the paint evenly on the surface.

To reduce the time necessary to deposit paint on a surface, the roller-brush was developed. Although the roller-brush decreases the time necessary to deposit paint, the reservoir of paint is still remotely disposed with respect to the surface. This results in many of the drawbacks associated with the traditional bristle-brushes, including a relatively poor transfer efficiency. In addition, roller-brushes are not particularly suited for surfaces with rough textures, because it is difficult for the roller-brush to deposit liquid in deep recesses associated therewith.

The inner feed pressure roller-brush addresses the problem of remotely disposing a paint reservoir from a surface to be covered with paint. Titan Tool, Inc. describes, in a sales brochure, an inner feed pressure roller-brush including an auger rotatably disposed with respect to a hollow frame, with the roller-brush fitting over the auger. The auger includes a plurality of orifices in fluid communication with the hollow frame. Paint flows through the hollow frame and egresses from the plurality of orifices. The auger rotates through the length of the roller-brush to distribute the paint along the inner roller surface. The inner roller surface is sufficiently porous to allow the paint to flow to the external surface of the roller-brush. A drawback with this device is that it is subject to premature failure due to clogging of the orifices and the roller-brush. The clogging causes an uneven distribution of paint observed as a polka-dot pattern. This requires many passes of the roller over the same area to provide a uniform paint distribution. In addition, the roller-brush suffers from the inherent problem of being unsuitable to deposit paint in the recesses of rough or textured surfaces.

Spray-guns are well known in the art and overcome many of the aforementioned drawbacks associated with brush applicators. Traditionally, there are two designs for spray-guns. One design employs pressurized air to atomize liquid producing a plurality of atomized liquid particles exiting a nozzle, with the nozzle positioned proximate to a surface on which the liquid is to be deposited. The other design of spray-guns forms a high-pressure fluid stream without air-flow assistance. In this manner, a high pressure stream reaches the nozzle, with the nozzle designed to disperse the stream forming, on the surface, a fluid envelope of desired geometry. This provides an improved transfer efficiency, typically 65%, as compared with the air-flow assisted spray-guns, which is typically 40%. In both of the aforementioned designs, the nozzle of the spray gun is remotely disposed with respect to a reservoir storing the liquid. The nozzle and the reservoir are kept in fluid communication via high pressure conduits. Drawbacks associated with the spray-guns is that high pressure liquids impinging upon a surface often "bounce-back", creating "over-spray" which speckles objects located in the environs about the surface to be coated. This reduces transfer efficiency, with the transfer efficiency of the air-atomization spray-gun being worsened by the ease with which atomized liquid is carried by wind. In addition, obtaining a uniform coating on a surface is often difficult, because inexperience and undertrained users of a spray-gun tend to move the spray-gun in a arcuate pattern with respect to the plane of the surface being coated. Finally, the bounce back phenomenon makes spray-guns unsuitable for close proximity spraying.

Titan Tool, Inc. describes, in a sales brochure, a combination roller-brush and spray-gun in which a single roller, having a longitudinal axis, is disposed spaced-apart from a spray nozzle. The nozzle produces a liquid stream extending tangentially upon the circumference of the roller, along the entire longitudinal axis. To deposit liquid upon a surface, the combination is moved so that the spray-gun deposits the liquid onto the surface with the roller-brush following the spray-gun to uniformly spread the liquid across the surface. A drawback with the Titan roller-brush and spray-gun combination is that it may be used in only one direction, thereby precluding one continuous motion for depositing liquid upon a surface. In addition, the distance between the nozzle and the surface is not fixed, resulting in a stripe having a variable width being deposited upon a surface, as shown in FIG. 1. Both of these drawbacks increase the time necessary to cover a given area of a surface. In addition, the transfer efficiency is greatly reduced due to the significant overlapping of adjacent stripes necessitated to cover an entire surface, shown as 11. The transfer efficiency of the Titan Tool, Inc. device is typically around 65%. In addition, the liquid envelope produced by the nozzle must be sufficiently narrow to avoid impinging upon the roller-brush, which would result in a great amount of over-spray being created. This reduces the area of the surface being sprayed, also increasing the time necessary to cover a given surface. Finally, with the nozzle and the roller-brush in fixed orientation with respect to each other, the combination is unsuitable for depositing liquid upon surfaces in close proximity with each other.

U.S. Pat. No. 3,015,837 to Teall discloses a combination roller-brush and low pressure air-atomization spray-gun in which two spaced-apart rollers are attached to a frame and positioned on opposite sides of a plurality of nozzles. Although the nozzles of the Teall invention provide a wider spray envelope than the Titan Tool, Inc. device, the nozzles are maintained in an optimal position with respect to the rollers so that the nozzles are surrounded by the rollers and the frame. In this manner, over-spray is substantially reduced and may be obviated altogether by placing a resilient shield over the rollers and the nozzles, making it difficult to observe the area of the surface to which liquid is being deposited. However, bounce-back is still prevalent due to the close proximity between the surface and the nozzle, which results in a poor transfer efficiency. In addition, with the nozzle and the roller-brushes being in fixed orientation with respect to each other, the combination is unsuitable for depositing paint upon surfaces in close proximity with one another. Another drawback with the Teall device is that it is rather large and cumbersome, making it difficult for a user to hold and use for long periods of time. Also, roller replacement and cleaning are difficult.

What is needed is a relatively light-weight liquid applicator that allows depositing liquid upon a surface in one continuous motion while avoiding over-spray from depositing upon the environs associated with the area to receive liquid.

SUMMARY OF THE INVENTION

A roller-brush applicator combined with a spray-gun is provided which allows dynamically displacing the roller-brushes with respect to a nozzle of the spray-gun while liquid is applied to a surface, providing a liquid transfer efficiency of nearly 90%. Dynamically displacing the roller-brushes allows varying the angle of a fluid stream exiting the nozzle with respect to the longitudinal axis of the roller-brushes to more accurately control over-spray. The roller-brush applicator includes a frame having first and second opposed ends, with a connecting means, attached to the first end, for attaching the frame proximate to the nozzle, and a cross member pivotally mounted to the second end to rotate about a pivot axis. The cross member preferably includes a pair of spaced apart roller-brushes, each of which is rotatably mounted to a shaft. The shafts extend parallel to, and are disposed on opposite sides of, the pivot axis. The nozzle defines a flow path extending between the spaced-apart roller-brushes, transverse to the pivot axis.

BEST MODE FOR CARRYING OUT THE INVENTION

Figure 1:
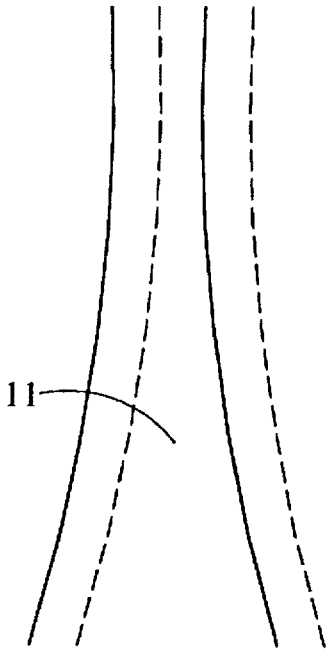
FIG. 1 (PRIOR ART)
FIG. 1 is a plan view showing stripe patterns of paint deposited upon a surface using a device of the prior art.
Figure 2:
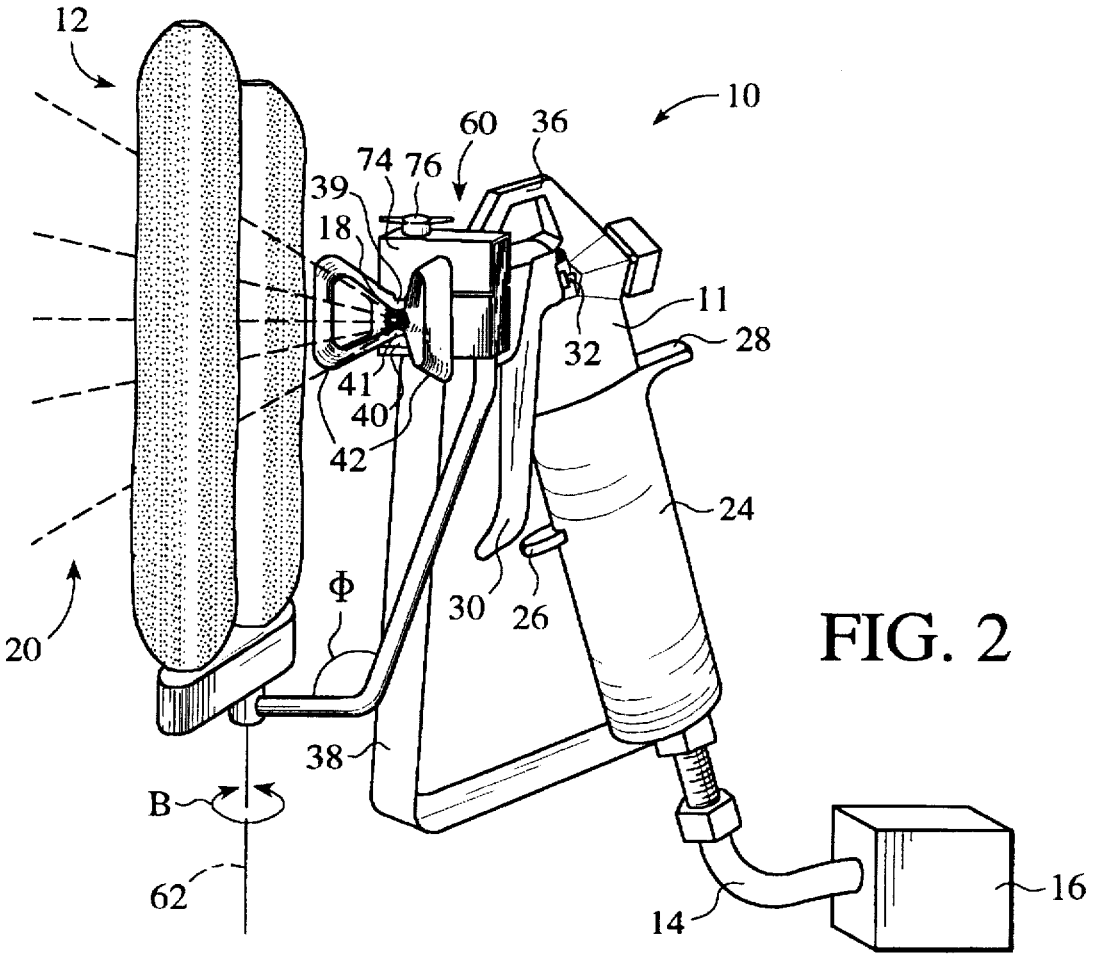
FIG. 2 is a perspective view of a first embodiment of the present invention.

With reference to FIG. 2, the apparatus of the present invention features a hand-held fluid spray-gun 10 in combination with a roller-brush applicator 12 disposed in front of the manifold body 11. Attached to the body 11 from below is an inlet conduit 14 which is in fluid communication with a pressurized source of fluid 16. A nozzle 18 is attached to an opposite end of the body 11, proximate to an outlet, not shown. The nozzle 18 allows a spray of fluid 20 exiting from the outlet to travel toward the roller-brush applicator 12. The body 11 has a grip 24 to facilitate holding the gun 10 by a hand of an operator, not shown, with the grip having a front projection 26 and a rear projection 28 which provide support for the hand holding the gun 10. Disposed above the front projection 26 is a trigger 30 in a position for operation by an index finger of an operator while other fingers of the operator hold the grip 24 below the front projection 26.

The trigger 30 is resiliently disposed to be held away from the grip 24. When moved inwardly toward the grip 24, the trigger 30 actuates a push rod 32, which in turn opens a valve, not shown. The valve controls whether the pressurized fluid can flow through the gun 10 and selectively places the inlet conduit 14 and the outlet in fluid communication. With the trigger 30 moved inwardly, the valve is opened, and the spray of fluid 20 shoots from the nozzle 18. To protect the spray-gun 10 from damage, a top guard 36 projects from a top end. A metal wire 38, or like material, extends between the nozzle 18 and the grip 24, projecting forward thereof to surround the trigger 30 and provide protection for a hand holding the gun 10. A nozzle guard is positioned proximate to the nozzle 18 and includes a body 40 and a pair of projections 42. Each projection 42 is a hollow trapezoid. The projections 42 extend from the body and are symmetrically disposed on, and angled away from, opposite sides of the nozzle 18, with the portion of the projections 42 proximate to the nozzle 18 forming upper 39 and lower 41 notches. The nozzle guard serves to protect a user from the fluid spray 20, while allowing the fluid spray 20 to pass unobstructed.

Figure 3:
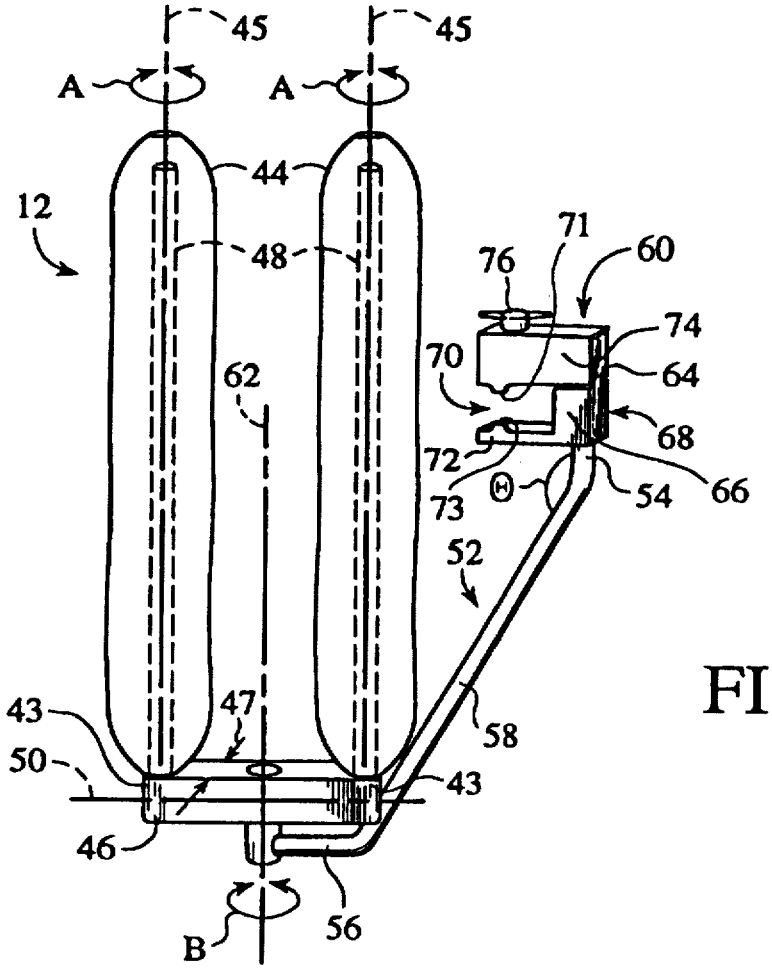
FIG. 3 is a perspective view of the apparatus shown in FIG. 2, without the spray-gun, for purposes of clarity.

Referring also to FIG. 3, the roller-brush applicator 12 includes two roller-brush members 44, disposed on opposite ends of a cross-member 46. Although any type of roller-brush may be employed, the roller-brushes are typically 6 inches in length, have a diameter measuring 1.25 inches and are commonly referred to as mini-roller-brushes. To that end, a shaft 48 is disposed at each end 43 of the cross-member 46, shown as dashed lines, with a roller-brush member 44 rotatably disposed thereon. Each shaft 48 extends along the same direction, perpendicular to the longitudinal axis 50 of the cross-member 46. The roller-brush members 44 may rotate in the direction shown by arrows A.

A frame 52 comprises of a single rod and includes first 54, second 56 and third 58 portions which extend parallel to a common plane. A clamp 60 is attached to the first portion 54 and is discussed more fully below. The first portion 54 extends from the clamp 60, terminating in the third portion 58 and forming an oblique angle $\theta$ therewith. The third portion 58 extends from the first portion 54, terminating in the second portion 56, forming an oblique angle $\Phi$ therewith, with the absolute value of the difference between angles $\Phi$ and $\theta$ approximating 90°. The cross-member 46 is pivotally mounted to the end of the second portion 56, opposite to angle $\Phi$, defining a pivot axis 62. The pivot axis 62 extends parallel to shafts 48, with the shafts 48 and the pivot axis 62 typically lying in a common plane. In this manner, it can be said that the longitudinal axis 45 of the roller-brush members 44 extend parallel to the pivot axis 62. It is preferred that the roller-brush members 44 be symmetrically disposed on opposite sides of the pivot axis 62, with the pivot axis allowing the cross-member 46 to rotate in the directions indicated by arrow B.

The width 47 of the cross-member 46 is defined as being transverse to both the longitudinal axes 50 and 45. The width 47 at each end 43 of the cross-member 46 should be sufficiently wide to contact the second portion 56 of the frame upon the cross-member 46 being rotated to an extreme angle about pivot axis 62 to ensure that spray 20 may pass between roller-brush members 44. In this manner, the cross-member 46 functions as a stop. However, it should be understood that a rubber grommet, or the like, may be attached to each end 43 of the cross-member 46 to act as a stop.

The clamp 60 includes a body 64 having first 66 and second 68 opposed major surfaces, with a recess 70 disposed therein, forming a fixed jaw 72. A moveable jaw 74 is disposed opposite to the fixed jaw 72 and includes a lever 76 to secure the position of the moveable jaw 70 with respect to the fixed jaw 72. The fixed jaw includes a tooth 71 positioned proximate to the first surface, extending toward the movable jaw 74. Movable jaw 74 includes a tooth 73 extending therefrom toward tooth 71 and in opposing relation therewith. The clamp 60 is positioned on the first portion 54 of the frame 52 so that the normal to the first major surface extends perpendicular toward the pivot axis 62. The recess 70 receives the body 40 of the nozzle guard, and the lever 76 is adjusted so that the body 40 is wedged between the fixed 72 and moveable 74 jaws. Teeth 71 and 73 are received with the upper 39 and lower 41 notches, respectively. In this manner, the teeth 71 and 73 form an interlocking fit with notches 39 and 41 to securely affix applicator 12 to the spray-gun 10. In this position, the nozzle 18 is aligned to face the pivot axis 62.

Figure 4:
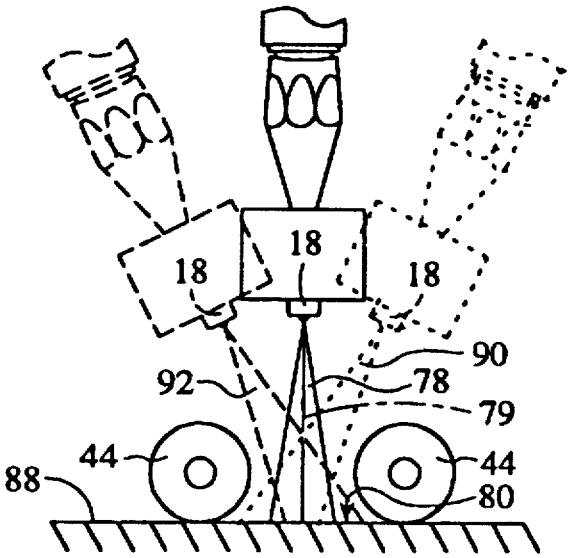
FIG. 4 is a top view of the apparatus shown in FIG. 2, demonstrating the path of a fluid stream compared to a spatial displacement of the roller-brushes with respect to a nozzle.
Figure 5:
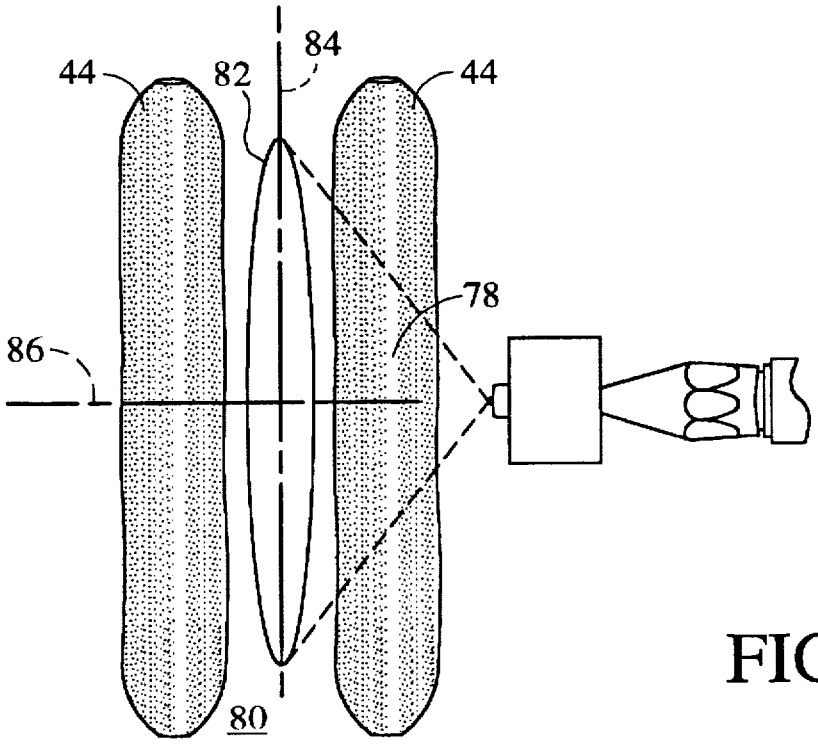
FIG. 5 is plan view showing a spray envelope produced by the nozzle of the apparatus shown in FIG. 4, in accord with the present invention.

Referring also to FIGS. 4 and 5, fluid 20 exiting the nozzle 18 creates a fluid stream 78 having a predetermined geometry that impinges upon a target plane 80, which is generally defined between roller-brush members 44. The fluid stream 78 traverses a flow path 79 defined by the nozzle 18 and fans-out in two directions, forming a fluid envelope 82 upon reaching the target plane 80. The shape and size of the fluid envelope 82 is dependent upon the nozzle 18 employed and the distance between the target plane 80 and the nozzle 18. Although any shape envelope may be formed, the preferred shape of the fluid envelope 82 is that of an ellipsis with the major axis 84 typically extending coextensive with the length of the roller-brushes 44. The minor axis 86 is typically centered along the length of the roller-brushes 44.

In operation, the invention may be used to apply any liquid, e.g., adhesives, to any surface and will be discussed with respect to depositing paint on a wall. The roller-brush members 44 are firmly pressed against the wall 88 that is to receive a coat of paint. The target plane 80 is typically a portion of the wall 88 located between roller-brush members 44. As the spray-gun 10 moves back and forth over the wall, the nozzle 18 distributes the paint in the shape of the flow envelope 82. The roller-brush members 44 spread the paint deposited in the flow envelope 82, over the wall, into a uniform coat. It is apparent that only one roller-brush member 44 spreads the flow envelope 82 at any given time, i.e., the roller-brush member 44 following the nozzle 18 in the direction the spray-gun 10 moves. As the spray-gun 10 moves back-and-forth on the wall 88, the cross-member 46 is allowed to rotate about pivot axis 62. The longitudinal axis 45, of the roller-brush members 44, is displaced with respect to the nozzle 18, and the fluid stream 78, allowing one roller-brush member 44 to move closer thereto, and one further therefrom, while the distance between the target plane 80 and the nozzle 18 remains fixed. This allows the distance between the nozzle 18 and the target plane 80 to be independent of the rotational position of cross-member 46 about axis 62. In this manner, one of the roller-brush members 44 may be positioned so that the fluid stream passes tangentially thereto, shown as fluid streams 90 and 92, which traps the paint thereunder, acting as a shield to prevent over-spray from depositing on the environs about the wall 88. This is particularly useful in that a wall to be painted often terminates adjacent to an object which may be advantageous to shield against paint spray, e.g. a baseboard or a ceiling.

Figure 6:
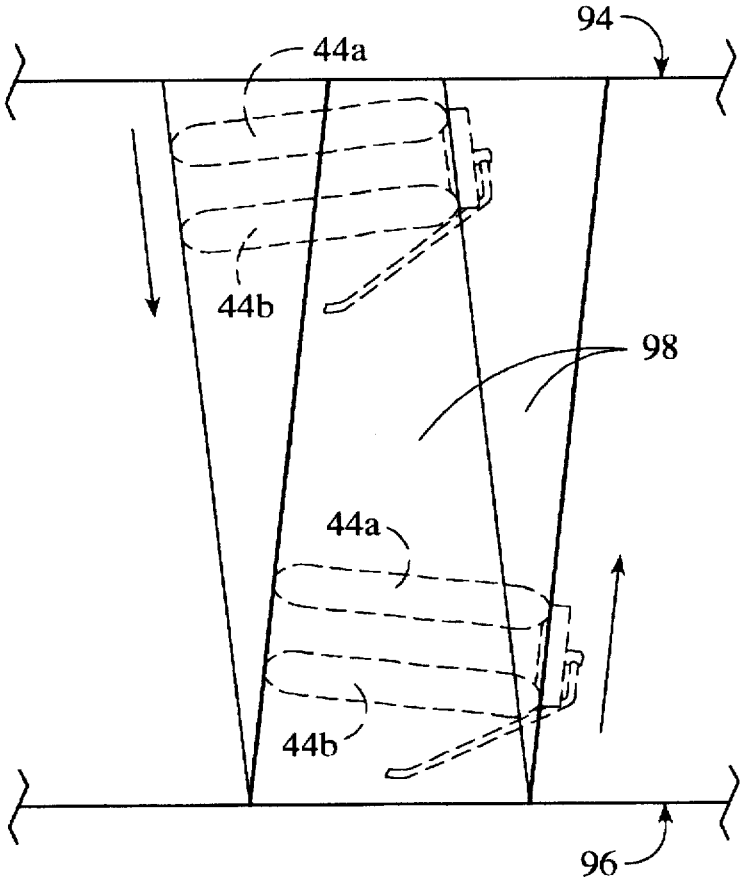
FIG. 6 is a plan view showing stripe patterns of paint deposited upon a surface using an apparatus in accord with the present invention.

For example, as shown in FIG. 6, the wall terminates between a ceiling 94 and floor 96. The preferred method of covering the wall with paint is to apply paint by moving the spray-gun in one motion, e.g., from ceiling 94 to floor 96. With the nozzle 18 positioned proximate to the ceiling 94, the fluid stream 78 passes tangentially to the top roller-brush member 44*a*, with a portion of the spray landing on the wall lying beneath member 44*a*, as shown in FIG. 4. This prevents paint from impinging upon ceiling 94. In a similar instance, the bottom roller-brush member 44*b* prevents paint from depositing on the floor 96. A further advantage with having two roller-brush members 44 is that wall 88 may be covered in one continuous motion, shown as strips 98. As can be seen in FIG. 6, there is slight overlap among the strips to ensure the wall is completely covered. By maintaining a fixed distance between the nozzle 18 and the target area 82, the width of each strip 98 is made uniform, allowing for a more even distribution of the paint. To further facilitate an even distribution of paint, the frame is formed from a resilient material, such as aluminum or a polymer compound, so that the nozzle 18 is not subjected to the vibration and pounding of moving the roller-brush members 44 across the wall 88. With the nozzle 18 separate from the pivoting applicator 12, flexible hoses are obviated, thereby reducing the effort necessary to use the spray-gun 10.

Figure 7:
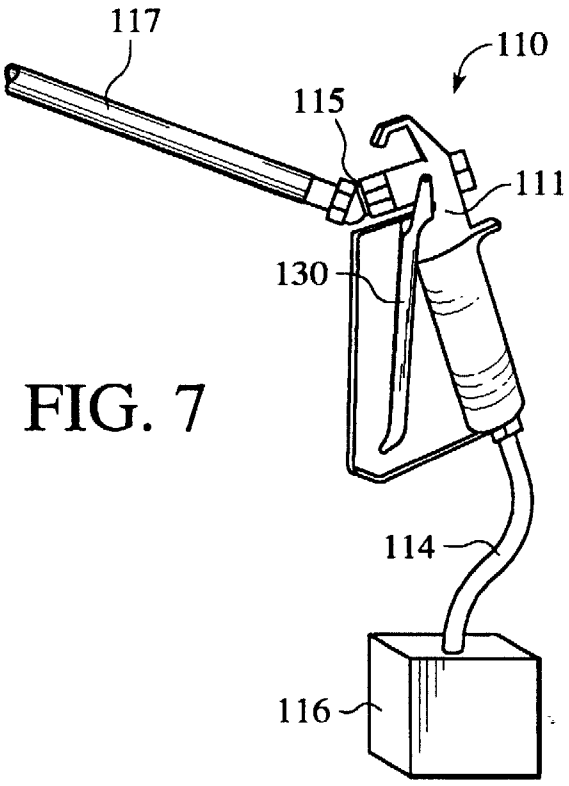
FIG. 7 is a side view of an alternate embodiment of the apparatus of the present invention.

Referring to FIG. 7, another embodiment of the spray-gun 110 is shown, with an inlet conduit 114 attached to one end of the manifold body 111. Conduit 114 is in fluid communication with a pressurized source of fluid 116. Disposed at the opposite end of the body 111 is an outlet 115 which is selectively placed in flow communication with the inlet conduit 114 by the trigger 130 and valve (not shown) assembly as discussed above with respect to FIG. 2. Disposed between the outlet 115 and a nozzle 118 is an elongated wand 117. The wand 117 allows the nozzle 118 to be remotely disposed with respect to manifold body 111 of the spray-gun 110. The nozzle 18 and the brush applicator are structured and attached as discussed above with respect to FIGS. 2 through 5. The primary difference in this embodiment is that the wand 117 facilitates painting areas that would otherwise be beyond the reach of an unaided user. This enables a user to cover larger areas with less physical exertion.

Figure 8:
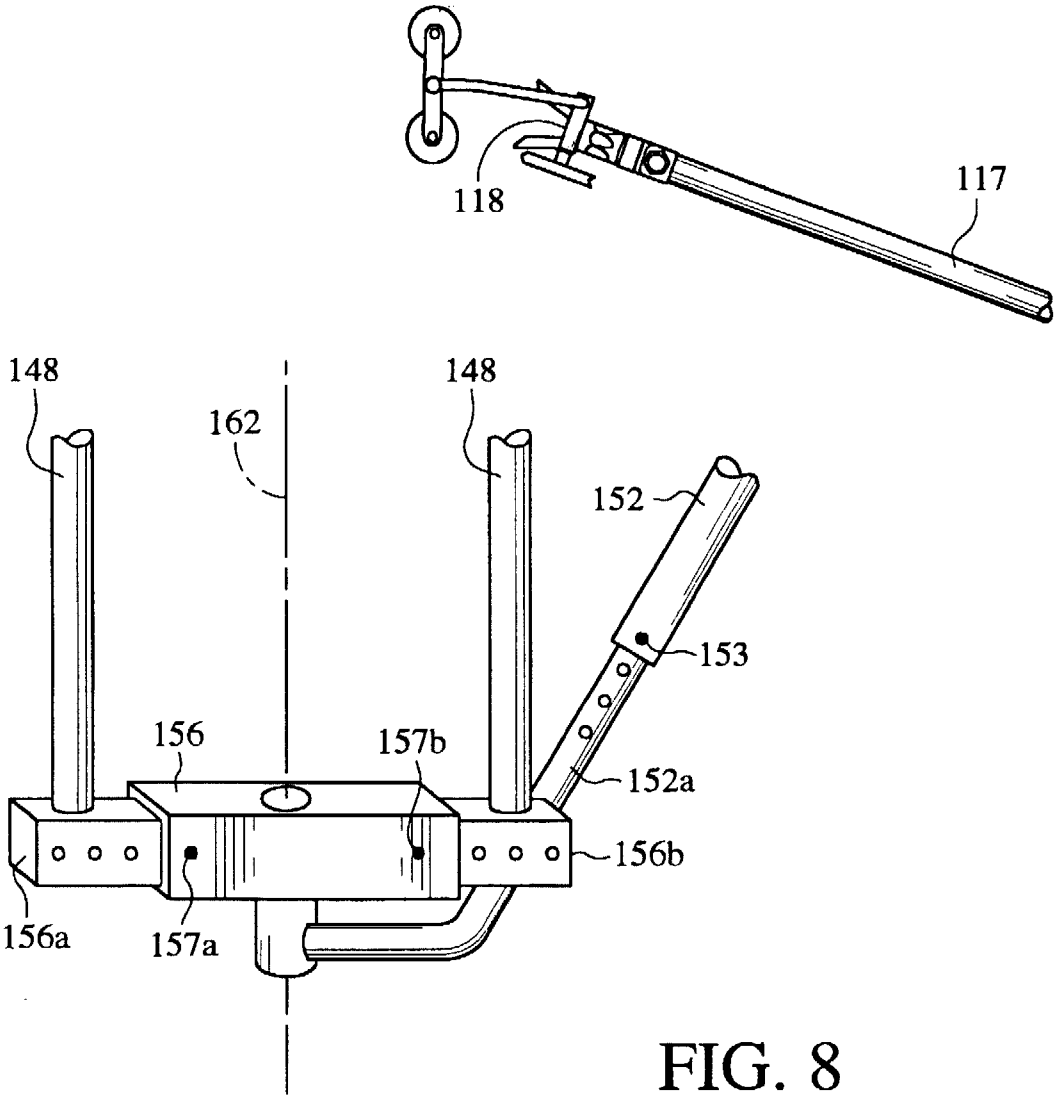
FIG. 8 is a perspective view of an alternate embodiment of the apparatus shown in FIG. 2.

Referring to FIG. 8, an alternative embodiment of frame and cross-member is shown. Although the spray-gun has been described with respect to using mini-roller-brushes, it should be understood that any size roller-brush may be employed. To that end, cross-member 156 includes two telescopic portions 156*a* and 156*b*, disposed on opposite sides of the pivot axis 162. Each of the telescopic portions 156*a* and 156*b* lock in place with pins 157*a* and 157*b*, respectively, allowing the shafts 148 to be displaced closer to, or further from, the pivot axis 162. Providing the spray-gun with an adjustable cross-member 156 allows employing roller-brush members 44 of differing sizes. This in turn allows differing nozzles to be employed to produce larger flow envelopes. The frame 152 may, therefore, include a telescopic portion 152*a* that locks in place with pin 153 to ensure that the minor axis of the ellipsis associated with the fluid envelope remains centered with respect to the nozzle.

I claim:

1. An applicator for applying fluid to a surface comprising, a spray-gun of the type having a nozzle defining a flow path across which said fluid will travel;

a frame having a first and second end;

a connecting means, attached to said first end, for connecting said frame proximate to said nozzle;

a pair of spaced-apart roller-brush members, defining a target plane therebetween; and means, connected between said spaced-apart roller-brush members and said second end, for dynamically displacing said spaced-apart roller-brush members with respect to said connecting means while preventing said roller-brush members from entering said flow path, with said spaced-apart roller-brush members extending from said displacing means.

2. The applicator as recited in claim 1 wherein said displacing means includes a cross-member pivotally mounted to said second end to rotate about a pivot axis, while maintaining a constant distance between said nozzle and said target plane, with said roller-brush members mounted on opposite sides of said pivot axis.

3. The applicator as recited in claim 1 wherein said displacing means includes a cross-member pivotally mounted to said second end to rotate about a pivot axis, with said cross-member having a length of sufficient size to contact said frame upon being rotated to an extreme angle about said pivot axis, whereby said roller-brush members are prevented from crossing into said flow path.

4. The applicator as recited in claim 1 wherein said frame comprises of a rod including first, second and third portions which extend parallel to a common plane, said first portion extending from said first end, terminating in said third portion and forming a first oblique angle therewith, with said third portion extending from said first portion, terminating in said second portion and forming a second oblique angle therewith, said connecting means attached to said first portion.

5. The applicator as recited in claim 3 wherein said cross-member has an adjustable length to vary a distance shafts are disposed from said pivot axis.

6. The applicator as recited in claim 4 wherein said first, second and third portions define a length, with said frame including a means for adjusting said length, thereby allowing roller-brush members of differing dimensions to be employed on said applicator.

7. The applicator as recited in claim 4 wherein said connecting means includes a body having first and second major surfaces, said body having a recess formed therein to receive said spray-gun and a clamp means for securely fastening said spray-gun thereto.

8. A fluid applicator system comprising, a manifold body, including a fluid inlet and a fluid outlet and means for selectively placing said inlet and outlet in flow communication;

a nozzle in fluid communication with said outlet, defining a flow path over which said fluid travels;

means, in fluid communication with said inlet, for remotely storing a fluid, with respect to said inlet, and transporting said fluid to said inlet under pressure; and an assembly removably attachable to said manifold body including a frame having a first and second end, a connecting means, attached to said first end, for attaching said frame proximate to said outlet, a pair of spaced-apart roller-brush members each having a longitudinal axis, with said flow path extending between said nozzle and said roller-brush members, transverse to said longitudinal axis, and means, attached to both said frame and said roller-brush members, for dynamically displacing the longitudinal axes of said roller-brush members with respect to said flow path so as to maintain said roller-brush members outside of said flow path.

9. The system as recited in claim 8 wherein said displacing means includes a cross-member pivotally mounted to said second end to rotate about a pivot axis, and a pair of shafts disposed on opposite sides of said pivot axis and extending parallel to said longitudinal axis with said roller-brush members rotatably mounted to said shafts.

10. The system as recited in claim 8 wherein said frame consists of a resilient rod adapted to attenuate vibrational forces propagating between said first and second ends.

11. The system as recited in claim 8 further including an elongated wand disposed between said nozzle and said outlet to remotely dispose said nozzle with respect to said manifold body.

12. The system as recited in claim 9 wherein said cross-member has an adjustable length to vary a distance said shafts are disposed from said pivot axis.

13. The system as recited in claim 8 wherein said frame has a length and includes a means for adjusting said length, thereby allowing roller-brush members of differing dimensions to be employed on said applicator.

14. The system as recited in claim 13 wherein said connecting means includes a bracket body having first and second major surfaces, said bracket body having a recess formed therein to receive said manifold body and a clamp means for securely fastening said manifold body thereto.

15. An applicator system for applying fluid to a surface comprising, a manifold body, including a fluid inlet and a fluid outlet and means for selectively placing said inlet and outlet in flow communication, with said outlet defining a flow path;

a nozzle in fluid communication with said outlet, defining a flow path over which said fluid travels;

means, in fluid communication with said inlet, for remotely storing said fluid, with respect to said inlet, and transporting said fluid to said inlet under pressure; and a demountable assembly including a frame having first and second opposed ends, with a connecting means, attached to said first end, for attaching said frame proximate to said outlet, and a cross-member pivotally mounted to said second end to rotate about a pivot axis, said cross-member including a pair of spaced-apart roller-brushes each of which are rotatably mounted to a shaft, the shafts being disposed on opposite sides of said pivot axis, with said flow path extending between said nozzle and said spaced-apart roller-brushes and said cross-member adapted to contact said frame upon being rotated to an extreme angle about said pivot axis, whereby said roller-brushes are prevented from obstructing said flow path.

16. The system as recited in claim 15 wherein said outlet is spaced-apart from said pair of roller-brushes, and said cross-member includes opposed ends, each of which includes a stop to maintain said flow path between said spaced-apart roller-brushes, independent of a rotational angle of said cross-member about said pivot axis.

17. The system as recited in claim 16 further including an elongated wand disposed between said nozzle and said outlet to remotely dispose said nozzle with respect to said manifold body.

18. The system as recited in claim 17 wherein said cross-member has an adjustable length to vary a distance said shafts are disposed from said pivot axis.

19. The system as recited in claim 18 wherein said frame comprises of a rod including first, second and third portions which extend parallel to a common plane, said first portion extending from said first end, terminating in said third portion and forming a first oblique angle therewith, with said third portion extending from said first portion, terminating in said second portion and forming a second oblique angle therewith, said connecting means attached to said first portion.

20. The system as recited in claim 19 wherein said first, second and third portions define a length, with said frame including a means for adjusting said length, thereby allowing roller-brush members of differing dimensions to be employed on said applicator.

* * * * *